United States Patent [19]

Harrison

[11] 4,059,149

[45] Nov. 22, 1977

[54] SELF-OPERATING CHEMICAL FEEDER FOR AN OIL WELL

[75] Inventor: Robert J. Harrison, Hominy, Okla.

[73] Assignee: Texaco Inc., New York, N.Y.

[21] Appl. No.: 733,660

[22] Filed: Oct. 18, 1976

[51] Int. Cl.[2] ..... E21B 43/00

[52] U.S. Cl. ..... 166/64; 137/624.13

[58] Field of Search ..... 166/64, 90, 244 C, 305 R, 166/67, 75 R; 137/624.11, 624.13, 624.15, 15, 268

[56] References Cited

U.S. PATENT DOCUMENTS

| | | | |
|---|---|---|---|
| 3,156,537 | 11/1964 | McLeod | 137/624.15 |
| 3,228,472 | 1/1966 | Rhoads | 166/64 |
| 3,707,160 | 12/1972 | Query | 137/624.15 |
| 3,901,313 | 8/1975 | Doniguian et al. | 166/64 |

*Primary Examiner*—Ernest R. Purser
*Assistant Examiner*—Richard E. Favreau
*Attorney, Agent, or Firm*—Carl G. Ries; Thomas H. Whaley; Theron H. Nichols

[57] ABSTRACT

A self-operating chemical feeder for an oil well is disclosed comprising a new combination of valves, Timers, a pump, an injection line, a flush line, and a tank of chemical wherein a first valve is responsive to a first timer for repeatedly ejecting spaced apart consecutive precise slugs of a chemical to the injection line for delivery to the oil well and for spacing each of the slugs from the next consecutive slug by a predetermined precise period of time. A second valve is responsive to a second timer for ejecting spaced apart slugs of flush liquid to the injection line, one flush liquid slug for each chemical slug, and for spacing each of the flush liquid slugs by a predetermined precise period of time for insuring oil well treatment on a regular basis as scheduled and for eliminating personnel time required for manually flushing each precise slug of said chemical throughout the well for an extended period of time.

21 Claims, 1 Drawing Figure

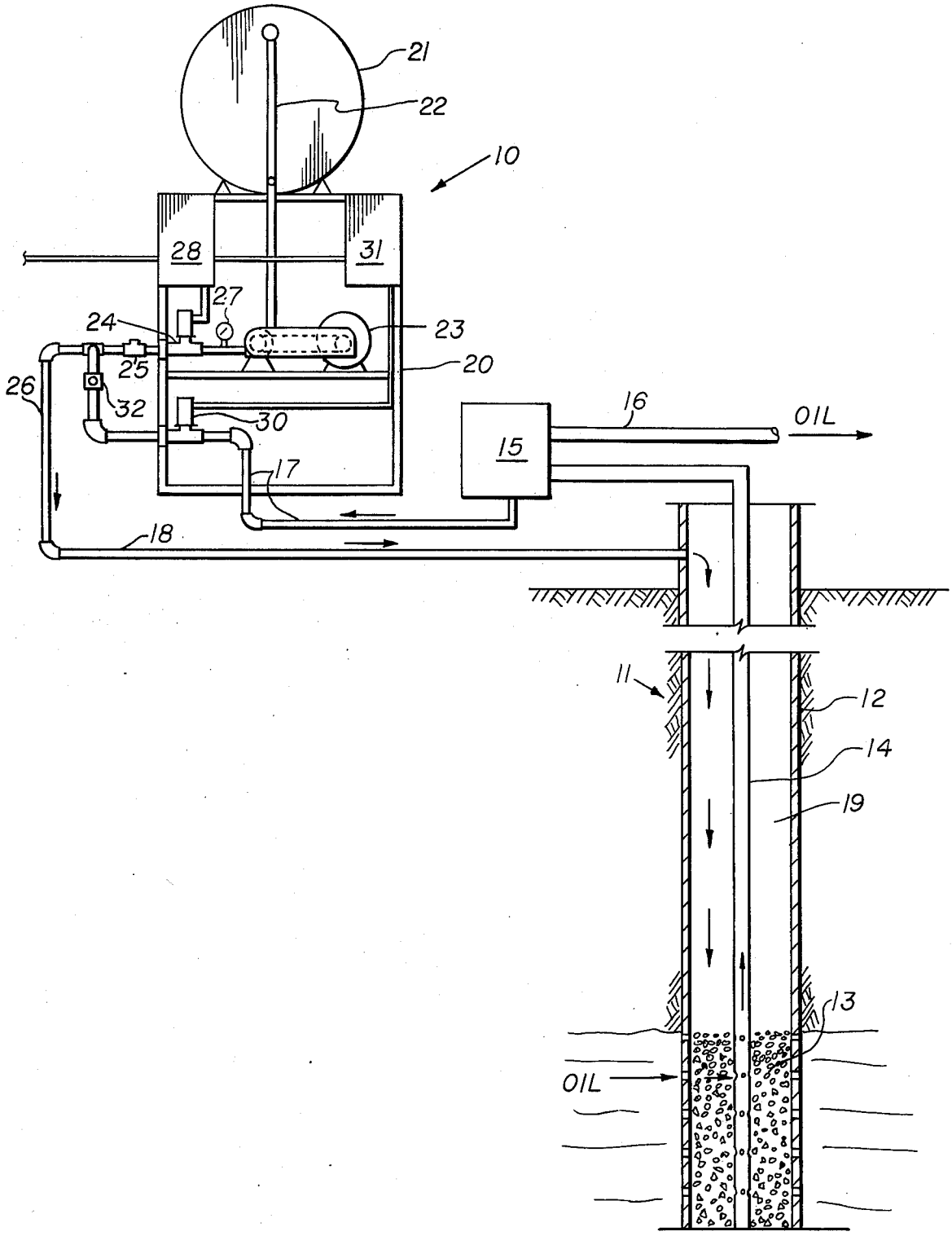
21
22
10
28
31
27
24
23
25
20
26
32
30
16
OIL
15
17
18
11
12
14
19
13
OIL

SELF-OPERATING CHEMICAL FEEDER FOR AN OIL WELL

BACKGROUND OF THE INVENTION

It is often desired and necessary to periodically treat producing wells with corrosion inhibitors or other types of treating chemicals. This regular treating of the well may comprise pouring a chemical from a tank of the chemical, such as the corrosion inhibitor through a conduit into a well, and manually measuring a slug of the chemical to the well. Immediately thereafter a flush fluid as a slug of higher pressure flush liquid, as water under pressure, from a suitable source must be measured out for pushing the slug of chemical to and throughout the well for treating the well, as coating all internal surfaces of the well casing and tubing with the corrosion inhibitor. This treatment must be done on a regular basis as scheduled, as once a week, if not sooner, for months and months on end, on many very remotely located wells. The personnel required to operate this oil well periodic corrosion inhibitor treatment, for example, with any degree of reliability, comprises a substantial investment and logistics problem.

To solve this problem, a self-operating chemical feeder system has been invented, designed, built, and put in operation on some remotely located oil wells.

OBJECTS OF THE INVENTION

Accordingly, a principal object of this invention is to provide a self-operating chemical feeder for a well for insuring well treatment on a regular basis as scheduled and for eliminating personnel time required for manual chemical treatment of the well for an extended period of time.

Another primary object of this invention is to provide self-operating chemical feeder for treating an oil well with measured precise slugs of corrosion inhibitor and with precise slugs of flush fluid injected behind each chemical slug for spreading the corrosion inhibitor throughout the well on a regular basis as scheduled for an extended period of time.

A further object of this invention is to provide a mechanism for ejecting a precise measured amount of a chemical slug and a measured slug of flush fluid for ejecting the chemical throughout an oil well on a regular basis as scheduled that is easy to operate, is of simple configuration, is economical to build and assemble, and is of greater efficiency for the saving of personnel time and for increased reliability on treating remotely located wells for an extended period of time.

Other objects and various advantages of the disclosed self-operated chemical feeder will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawing diagrammatically illustrates by way of example, not by way of limitation, one form of the invention wherein like reference numerals designate corresponding parts in the several views in which:

The FIGURE is a schematic diagrammatic vertical sectional view of a self-operating chemical feeder for treating an oil well.

DESCRIPTION OF THE PREFERRED EMBODIMENT

The invention disclosed herein, the scope of which being defined in the appended claims is not limited in its application to the details of construction and arrangement of parts shown and described, since the invention is capable of other embodiments and of being practiced or carried out in various other ways. Also, it is to be understood that the phraseology or terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

The FIGURE is a vertical sectional view illustrating the chemical feeder system 10 for treating a producing oil well 11.

The oil well 11 is a conventional producing oil well having a casing 12 perforated at the bottom for oil to pass through it, the gravel pack 13, and perforated production tubing 14 to the surface. Here the oil passes through a separator 15 from which oil is bled off in oil line 16 and water is bled off to a flush line 17. Injection line 18 from the chemical feeder 10 injects chemical slugs as pushed forward by slugs of wash liquid down into an annulus 19 in the well.

While this invention is particularly conceived and designed for use with oil and gas wells, with changes and additions it possibly may be designed and adapted to other wells.

The chemical feeder system 10 includes a steel rack 20 for supporting a 55 gallon (209 liters) chemical tank 21, for example, with sight glass 22 for supplying the chemical to a ⅓-horsepower electric pump 23. The chemical or chemicals from the pump pass through a conventional quick acting or ½-inch motor snap valve, as a solenoid valve 24, and then through check valve 25 to injection line 26 which injects the chemicals into the well 10. A pressure gauge 27 is connected in the line between the pump 23 and the valve 24. A timer or electric clock 28 is connected to valve 24 for metering out a predetermined precise amount or slug of chemicals, as a corrosion inhibitor, for the well every 7 days, for example.

A flush line 29 supplies a predetermined precise slug of flush liquid to the injection line 26 for pushing and carrying the chemical slug through the injection line to the well 11 for treating the well, as by coating all internal surfaces thereof with the corrosion inhibitor. This precision slug of flush liquid is metered from the flush line by a conventional quick action or solenoid or ½-inch motor snap valve 30 controlled by a second timer or 7-day electric clock 31 mounted on the steel rack 20. Check valves 25 and 32 prevent any back flow of flush liquid or chemical in the injection line or the flush line, respectively.

While the flush line is illustrated as being supplied with water from the oil-water separator 15, it may be supplied from any other suitable source.

Likewise, while the flush in the disclosed system comes from a separate line, it may emerge from the chemical feeder system already mixed with the chemical for being transported through the ejection line to the well. In the illustrated example, the flush may circulate the chemical or chemicals from 1 to 24 hours, as required, on any one or more days each week.

Thus with the disclosed chemical feeder, it is insured that wells will be treated on a regular basis as scheduled and that unnecessary personnel time will be eliminated, particularly for "batch" type treatments, for example.

Thus accordingly, it will be seen that the present self operating chemical feeder operates in a manner which meets each of the objects set forth hereinbefore.

While only one embodiment of the invention has been disclosed, it will be evident that various modifications are possible in the arrangement and construction of the disclosed self-operating chemical feeder without departing from the scope of the invention, and it is accordingly desired to comprehend within the purview of this invention such modifications as may be considered to fall within the scope of the appended claims.

I claim:

1. A self-operating chemical feeder for an oil well having a tube with a casing therearound forming an annulus in the well comprising, a. pump means on a chemical feeder housing for pumping a chemical into an injection line for passing down into the well, b. first valve means on said injection line for ejecting a slug of said chemical into the injection line and well, c. first timer means for controlling said first valve means, d. flush line means for supplying a high pressure flush liquid to said injection line for circulating said chemical throughout the well, e. second valve means for controlling the flow of said flush liquid in said injection line, f. second timer means for controlling said second valve means, g. said first valve means being responsive to said first timer means for being opened for a predetermined period of time for ejecting a precise slug of said chemical to said injection line for delivery to the well, and h. said second valve means being responsive to said second timer means for supplying a predetermined slug of flush liquid to said injection line for circulating said chemical slug throughout the well for insuring well treatment on a regular basis as scheduled and for eliminating personnel time required for manually flushing slugs of the chemical throughout the well for an extended period of time.

2. A self-operating chemical feeder as recited in claim 1 wherein, a. said pump means comprises a liquid pump mounted on said chemical feeder housing and connected between a tank of the chemical and said injection line for supplying said chemical to said injection line.

3. A self-operating chemical feeder as recited in claim 1 wherein, a. said first valve means comprises a solenoid valve mounted on said injection line downstream of said pump means for insuring snap action for controlling the injection of the precise slug of said chemical into said injection line for delivery to the well.

4. A self-operating chemical feeder as recited in claim 1 wherein, a. said first timer means comprises an electric clock mounted on said chemical feeder housing and connected to said first valve means for precise operation thereof for controlling the precise amount of said slug of chemical to said injection line for delivery to the well.

5. A self-operating chemical feeder as recited in claim 1 wherein, a. said flush line means comprises a flush line from a pressure source of flush liquid to said injection line downstream of said first valve means for supplying flush liquid under pressure to said injection line for delivery to the well.

6. A self-operating chemical feeder as recited in claim 1 wherein, a. said second valve means comprises a solenoid valve mounted on said flush line means for insuring snap action for controlling the injection of a slug of flush liquid into said injection line for delivery to the well.

7. A self-operating chemical feeder as recited in claim 1 wherein, a. said second timer means comprises an electric clock mounted on said chemical feeder housing and connected to said second valve means for precise operation thereof for controlling the size of the slug of flush liquid to said injection line for delivery to the well.

8. A self-operating chemical feeder as recited in claim 1 wherein, a. said first valve means is responsive to said first timer means for repeatedly ejecting spaced apart consecutive precise slugs of chemical to said injection line means for delivery to the well, and b. said first valve means is further responsive to said first timer means for spacing each of said slugs from the next consecutive batch by a predetermined precise period of time for insuring well treatment on a regular basis as scheduled and for eliminating personnel time required for manually ejecting the precise slugs of the chemical to the well for an extended period of time.

9. A self-operating chemical feeder as recited in claim 8 wherein, a. said second valve means is responsive to said second timer means for ejecting spaced apart slugs of flush liquid to said injection line means, one flush slug for each chemical slug, and b. said second valve means is further responsive to said second timer means for spacing each of said flush slugs by a predetermined precise period of time for insuring well treatment on a regular basis as scheduled and for eliminating personnel time required for manually flushing each slug of said chemical throughout the well for an extended period of time.

10. A self-operating chemical feeder for a well having a tube with a casing therearound forming an annulus in the well comprising, a. housing means, b. container means for said housing means for storing a chemical, c. injection line means for supplying said chemical from said housing means to the well, d. pump means for said injection line means, e. first valve means for said injection line means for controlling the flow of a slug of said chemical through said injection line means to the well, f. first timer means for said first valve means for controlling the opening of said first valve means for a predetermined period of time, g. a flush line extending from a source of high pressure flush liquid to said injection line means for circulating said chemical slug throughout the well, h. second valve means for said flush line for controlling the flow of flush liquid through said flush line to said injection line, i. second timer means for said second valve means for controlling the opening of said second valve means for a predetermined period of time for forming a slug of flush liquid, j. said first valve means being responsive to said first timer means for being opened for the predetermined period of time for ejecting said precise slug of said chemical to said injection line means for delivery to the well, and k. said second valve means being responsive to said second timer means for being opened for the predetermined period for supplying said predetermined slug of flush liquid to said injection line means for circulating said slug of chemical through the injection line means and throughout the well for insuring well treatment on a regular basis as scheduled and for eliminating personnel time required for manually flushing slugs of said chemical throughout the well for an extended period of time.

11. A self-operating chemical feeder as recited in claim 10 wherein the injection line means comprises, a. a line extending from said chemical tank on said metal rack to the wall.

12. A self-operated chemical feeder as recited in claim 10 wherein said first valve means comprises, a. a solenoid valve mounted on said injection line means downstream of said pump means for insuring rapid action for controlling the injection of said precise slug of said chemical into said injection line for delivery to the well.

13. A self-operated chemical feeder as recited in claim 10 wherein said first timer means comprises, a. an electric clock mounted on said housing means, and b. said electric clock being connected to said first valve means for opening thereof for a precise period of time for passing said precise slug of chemical through said first valve means to said injection line for delivery to the well.

14. A self-operated chemical feeder as recited in claim 10 wherein said flush line comprises, a. a flush line extending from a source of high pressure flush liquid to said injection line downstream of said first valve means, and b. said flush line being means for supplying said flush liquid under pressure to said injection line for circulating said chemical slug throughout the well.

15. A self-operated chemical feeder as recited in claim 10 wherein said second valve means comprises, a. a solenoid valve mounted on said flush line upstream of the connection of said flush line with said injection line means, and b. said solenoid valve provides rapid action for controlling precisely the injection of the flush liquid into said injection line means for circulating said chemical slug throughout the well.

16. A self-operated chemical feeder as recited in claim 10 wherein said second timer means comprises, a. an electric clock mounted on said housing means, and b. said electric clock being connected to said second valve means for precisely controlling the opening of said second valve means for a predetermined period of time for controlling the amount of flush liquid to said injection line for circulation of said chemical slug through said injection line means and throughout said well.

17. A self-operating chemical feeder as recited in claim 10 wherein said housing means comprises, a. a metal rack positioned adjacent the well, and b. said metal rack having means for supporting various elements of the self operating chemical feeder.

18. A self-operating chemical feeder as recited in claim 17 wherein said chemical container means comprises, a. a chemical tank mounted on said metal rack, b. connecting means connecting said chemical tank to said injection line means, and c. said chemical tank having a sight glass for ready determination of the amount of chemical in said tank.

19. A self-operating chemical feeder as recited in claim 17 wherein said pump means comprises, a. a pump mounted on the metal rack, and b. said pump being connected to said injection line means for pumping said chemical from said chemical container means to said injection line means.

20. A self-operated chemical feeder as recited in claim 10 wherein, a. said first valve means is responsive to said first timer means for repeatedly ejecting spaced apart consecutive precise slugs of chemical to said injection line means for delivery to the well, and b. said first valve means is further responsive to said first timer means for spacing each of said slugs from the next consecutive slug by a predetermined precise period of time for insuring well treatment on a regular basis as scheduled and for eliminating personnel time required for manually ejecting the precise slugs of the chemical to the well for an extended period of time.

21. A self-operated chemical feeder as recited in claim 20 wherein, a. said second valve means is responsive to said second timer means for ejecting spaced apart slugs of flush liquid to said injection line means, one flush slug for each chemical slug, and b. said second valve means is further responsive to said second timer means for spacing each of said flush slugs by a predetermined precise period of time for insuring well treatment on a regular basis as scheduled and for eliminating personnel time required for manually flushing each slug of said chemical throughout the well for an extended period of time.

* * * * *